US010897095B2

(12) United States Patent
Hikota

(10) Patent No.: US 10,897,095 B2
(45) Date of Patent: Jan. 19, 2021

(54) TERMINAL COVER

(71) Applicant: Sumitomo Wiring Systems, Ltd., Mie (JP)

(72) Inventor: Naoki Hikota, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/666,997

(22) Filed: Oct. 29, 2019

(65) Prior Publication Data

US 2020/0136279 A1 Apr. 30, 2020

(30) Foreign Application Priority Data

Oct. 30, 2018 (JP) ..... 2018-203890

(51) Int. Cl.
*H01R 4/70* (2006.01)
*H01R 4/18* (2006.01)

(52) U.S. Cl.
CPC ..... *H01R 4/70* (2013.01); *H01R 4/183* (2013.01); *H01R 2201/26* (2013.01)

(58) Field of Classification Search
CPC ..... H01R 4/70; H01R 4/183; H01R 2201/26
See application file for complete search history.

(56) References Cited

U.S. PATENT DOCUMENTS 5,975,964 A * 11/1999 Seko ..... H01R 13/18 439/857
9,332,668 B2 * 5/2016 Nishio ..... H05K 5/0039
2012/0208395 A1 * 8/2012 Fujiwara ..... H01R 13/641 439/489
2014/0322989 A1 * 10/2014 Kaneko ..... H01R 11/12 439/723
2016/0006233 A1 * 1/2016 Oshiumi ..... H02G 15/22 174/76
2018/0226745 A1 * 8/2018 Hirano ..... H01R 13/5804
2020/0136279 A1 * 4/2020 Hikota ..... H01R 4/183

FOREIGN PATENT DOCUMENTS

JP 2015-097148 5/2015

* cited by examiner

*Primary Examiner* — Abdullah A Riyami
*Assistant Examiner* — Nader J Alhawamdeh
(74) *Attorney, Agent, or Firm* — Gerald E. Hespos; Michael J. Porco; Matthew T. Hespos

(57) ABSTRACT

A terminal cover (10) protects a terminal fitting (12) that has a barrel (18) crimped to a wire (W). The terminal cover (10) includes an accommodating portion (20) having a front opening (22), and the barrel (18) is accommodated in the accommodating portion (20). A lid (16) covers the front opening (22) of the accommodating portion (20), and two pressing portions (34) project obliquely toward the barrel (18) from opposed left and right inner wall (32A, 32B). The pressing portions (34) resiliently contact sides (18A, 18B) of the barrel (18). Each pressing portion (34) has a tapered end (38) inclined toward the front opening (22), and the tapered ends (38) resiliently contact the sides (18A, 18B) of the barrel (18). The barrel (18) is pushed toward the front opening (22) and sandwiched between the lid (16) and the pressing portions (34) by reaction forces of the pressing portions (34).

4 Claims, 6 Drawing Sheets

TERMINAL COVER

BACKGROUND

Field of the Invention

This specification relates to a terminal cover.

Related Art

Japanese Unexamined Patent Publication No. 2015-97148 discloses a terminal cover that includes a body for supporting a barrel of a terminal fitting and a lid openably and closably coupled to the body via a hinge. The lid is provided with a pressing portion for pressing the barrel between the body and the pressing portion by resiliently contacting the barrel in a closed state. The pressing portion is shaped to extend in a looped manner and at least one end is coupled to a covering wall.

However, the pressing portion resiliently contacts the barrel only in a mounting direction of the lid. Thus, the barrel may be displaced in a direction intersecting the mounting direction of the lid.

SUMMARY

This specification relates to a terminal cover for protecting a terminal fitting with a barrel that is to be crimped to an end part of a wire. The terminal cover has an accommodating portion with an opening, and the barrel is accommodated into the accommodating portion through the opening. The terminal cover also has a lid configured to cover the opening of the accommodating portion. Two plate-like pressing portions project obliquely toward the barrel from inner walls of the accommodating portion that face each other in a direction intersecting both an axial direction of the opening and an extending direction of the wire. The pressing portions resiliently contact both side parts of the barrel. An end of each pressing portion in a projecting direction is tapered to incline toward the opening. The tapered ends of the pressing portions resiliently contact the side parts of the barrel. Thus, the barrel is pushed toward the opening and is sandwiched between the lid and the pressing portions by reaction forces of the pressing portions.

The pair of pressing portions resiliently contact the side parts of the barrel to restrict displacement of the barrel in a direction intersecting a mounting direction of the lid (i.e. in a direction intersecting both the axial direction of the opening and the extending direction of the wire). Further, the tapered ends of the pressing portions incline toward the opening. Thus, the tapered ends of the pressing portions resiliently contact the barrel so that the barrel is pushed toward the opening while sliding on the tapered ends. Accordingly, the barrel is sandwiched between the lid and the pressing portions and cannot displace toward the opening.

The tapered end may include a first taper on a side near the opening and a second taper located on a side distant from the opening. The first taper may be inclined more gently than the second taper. Thus, the first taper functions as a guide in accommodating the barrel through the opening of the accommodating portion and the barrel is accommodated easily.

The pressing portion may include first and second plates. The first plate may project obliquely toward one side in the extending direction for resiliently contacting a first side of the barrel. The second plate may project obliquely toward the other side in the extending direction for resiliently contacting a second side of the barrel. Thus, a displacement of the barrel in the extending direction is suppressed. For example, if the barrel is going to be displaced toward the first side in the extending direction, a displacement of the barrel toward the first side in the extending direction is suppressed by the second plates projecting toward the second side in the extending direction. Further, if the barrel is going to be displaced toward the second side in the extending direction, a displacement of the barrel toward the second side in the extending direction is suppressed by the first plates projecting toward the first side in the extending direction.

According to the terminal cover disclosed in this specification, a displacement of the barrel accommodated in the accommodating portion in the direction intersecting the mounting direction of the lid for covering the opening of the accommodating portion is suppressed.

DETAILED DESCRIPTION

An embodiment is described with reference to FIGS. 1 to 5. In the following description, an X direction, a Y direction and a Z direction in FIGS. 1 to 5 are respectively referred to as a forward direction, a rightward direction and an upward direction. A terminal cover 10 of this embodiment is for protecting a terminal fitting 12 to be connected to a battery of a vehicle. The terminal cover 10 is formed of resin and includes a box-shaped body 14 and a lid 16.

Figure 4:
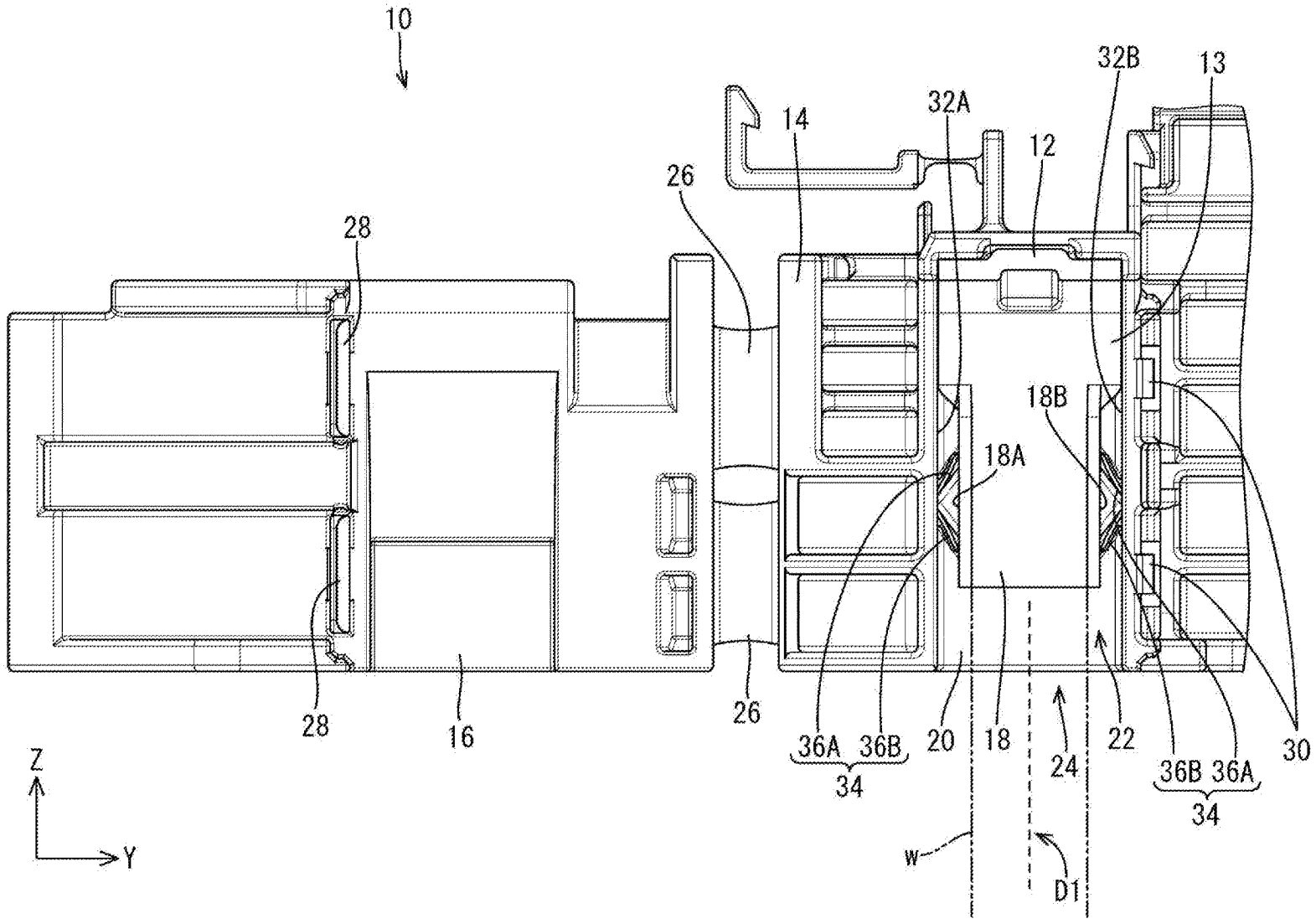
FIG. 4 is a front view of the terminal cover in a state where a barrel is accommodated.

As shown in FIG. 4, the terminal fitting 12 includes a rectangular terminal body 13 and a barrel 18. The barrel 18 has a tubular shape long in a vertical direction and projecting down from the terminal body 13. The barrel 18 is crimped and connected to an end part of a wire W, and the wire W extends down from the barrel 18. Further, a connecting portion to be connected to the battery projects rearward from the upper end of the terminal body 13.

Figure 1:
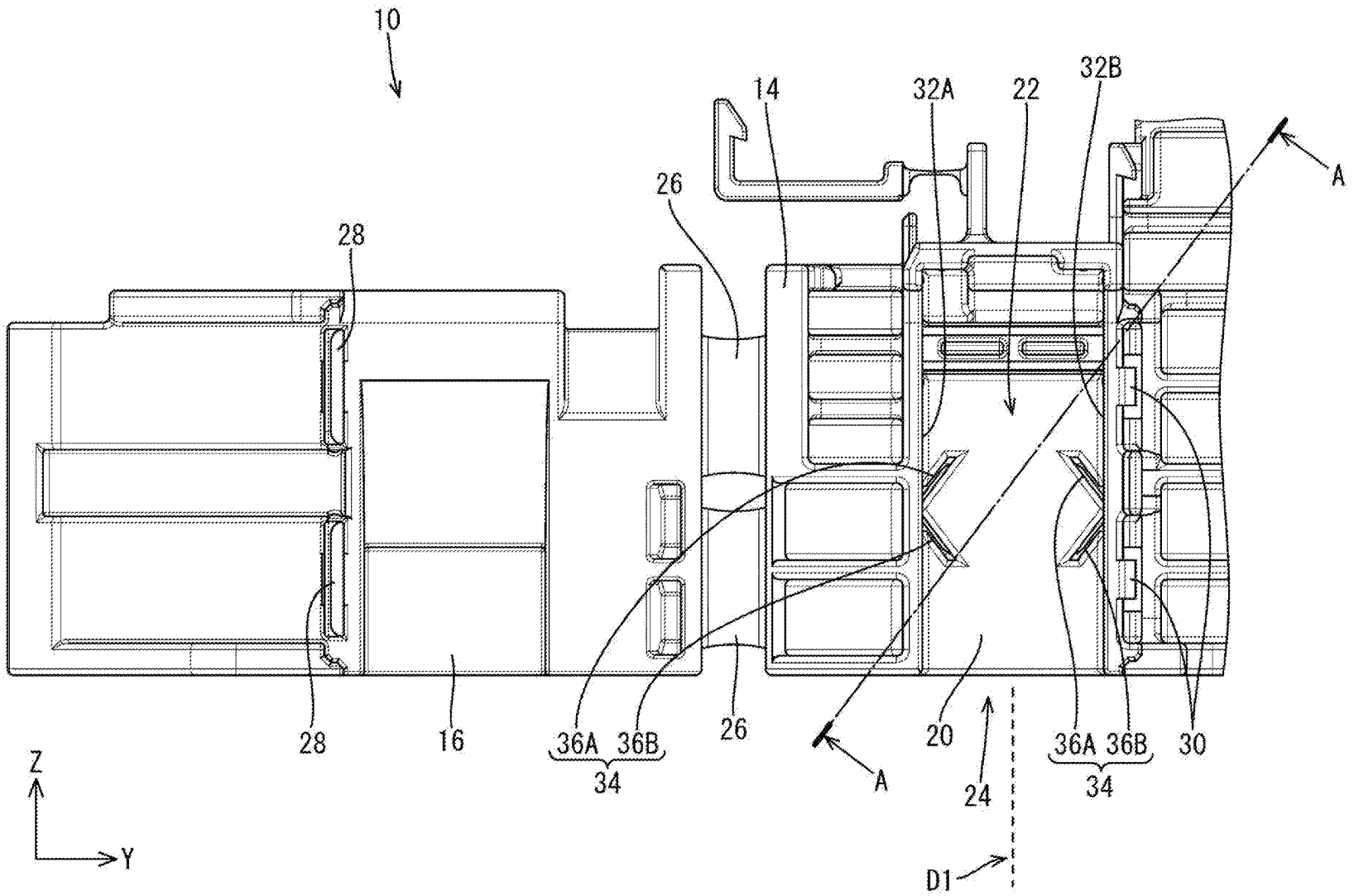
FIG. 1 is a front view of a terminal cover in an embodiment.
Figure 2:
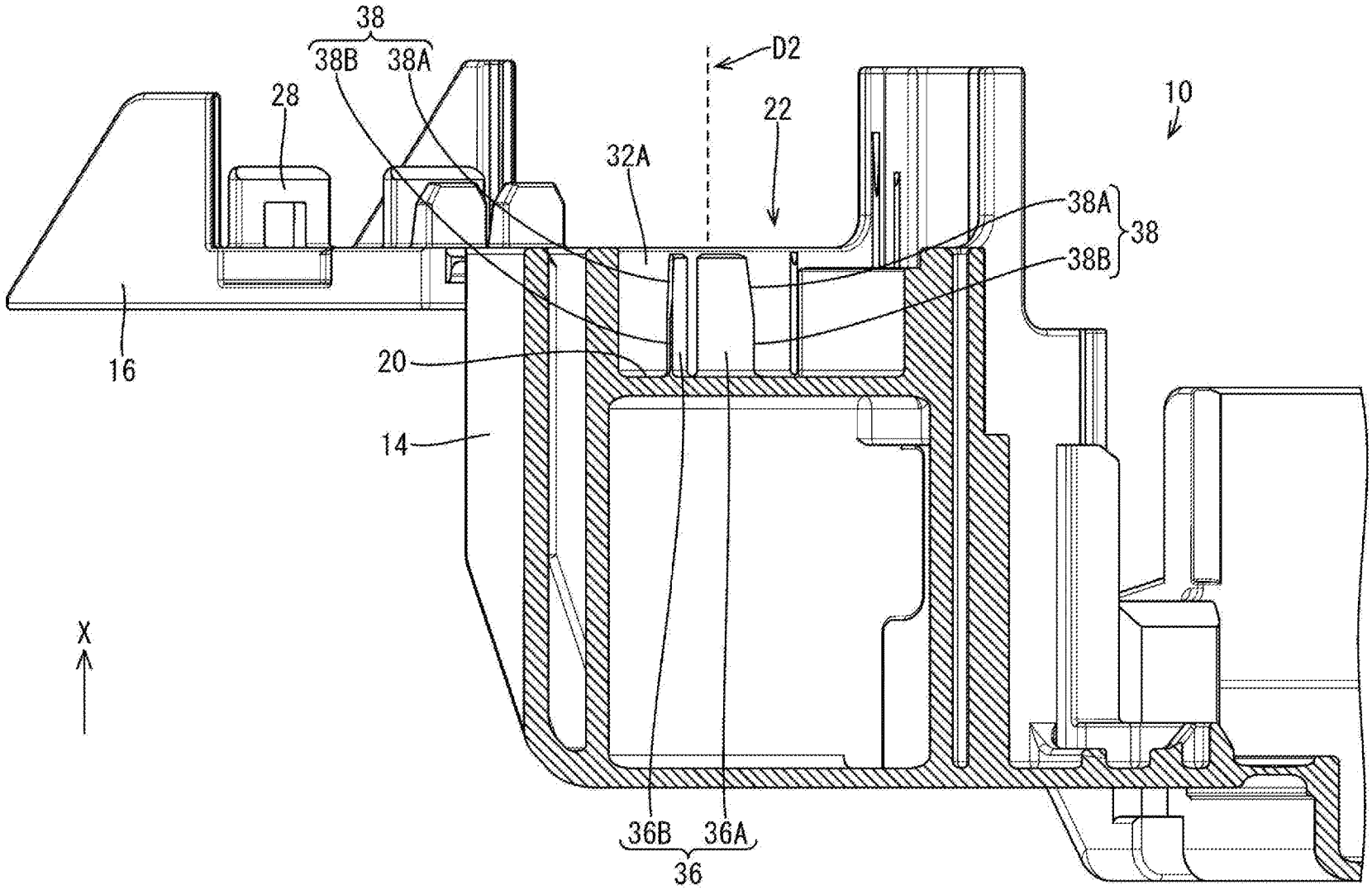
FIG. 2 is a section along A-A in FIG. 1.

As shown in FIGS. 1 and 2, the body 14 of the terminal cover 10 is provided with an accommodating portion 20 open forward and down, and the barrel 18 (shown in FIG. 4) is accommodated into the accommodating portion 20 through a front opening 22 of the accommodating portion 20. The wire W connected to the barrel 18 extends outwardly of the terminal cover 10 from a lower opening 24 in the accommodating portion 20.

Figure 5:
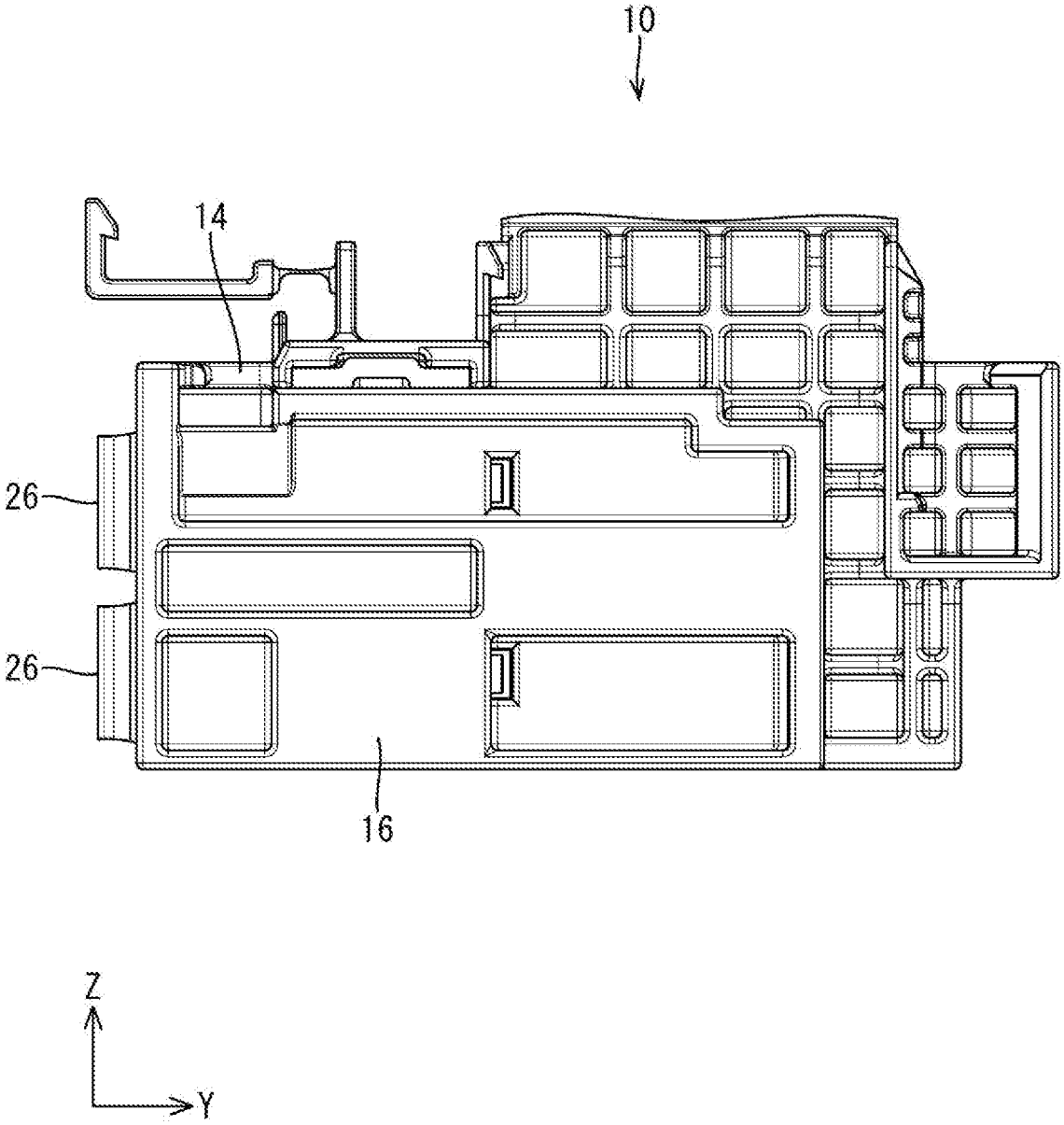
FIG. 5 is a front view of the terminal cover in a state where a lid covers an opening of an accommodating portion.

The lid 16 is coupled to the body 14 via upper and lower hinges 26 that permit the lid 16 to open and close. When the lid 16 is closed, the front opening 22 of the accommodating portion 20 is covered by the lid 16, as shown in FIG. 5.

As shown in FIGS. 1 and 2, two U-shaped laterally-displaceable first locks 28 displaceable project on a surface of the lid 16 facing the body 14 while being spaced apart by a predetermined distance in the vertical direction. Further, as shown in FIG. 1, two second locks 30 project on the right surface of the body 14 while being spaced apart by a predetermined distance in the vertical direction. When the lid 16 is closed, the second locks 30 are accommodated inside the first locks 28 so that the first locks 28 are locked to the second locks 30 and the lid 16 is mounted on the body portion 14.

As shown in FIG. 1, two plate-like pressing portions 34 project obliquely from a left inner wall 32A and a right inner wall 32B of the accommodating portion 20 to face each other in the lateral direction. The lateral direction intersects both an axial direction D2 of the front opening 22 (i.e. a front-rear direction and a mounting direction of the lid 16) shown in FIGS. 2 and 3 and an extending direction D1 of the wire W (i.e. the vertical direction) shown in FIG. 4. As shown in FIG. 4, when the barrel 18 is accommodated into the accommodating portion 20, the left and right pressing portions 34 resiliently contact left and right sides 18A, 18B of the barrel 18 to restrict lateral displacement of the barrel 18 in the accommodating portion 20.

As shown in FIG. 4, the pressing portion 34 is composed of a first plate 36A projecting obliquely up (oblique direction toward one side in the extending direction D1) from a central part of the inner wall 32A, 32B and a second plate 36B projecting obliquely down (toward the other side of the extending direction D1) from the central part of the inner wall 32A, 32B. The pressing portions 34 can deflect toward the inner walls 32A, 32B and resiliently contact both side parts 18A, 18B of the barrel 18.

Figure 3:
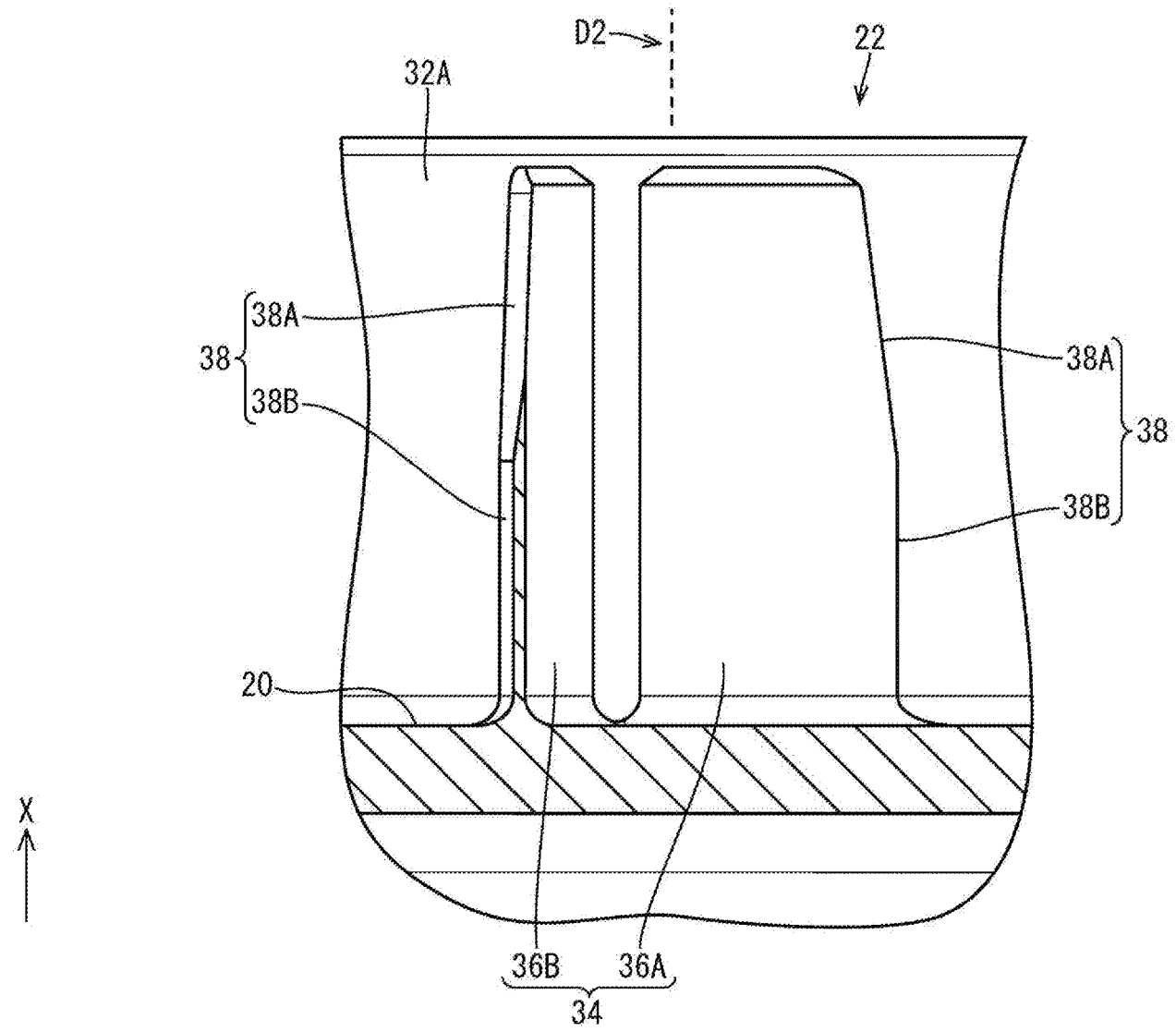
FIG. 3 is an enlarged view of a part near a pressing portion in FIG. 2.

As shown in FIGS. 2 and 3, ends of the first and second plates 36A, 36B in the projecting directions are formed into tapers 38 inclined toward the front opening 22. Each taper 38 is composed of a first tapered portion 38A located on a front side (side near the front opening 22) and a second tapered portion 38B located on a rear side (side distant from the front opening 22). The first tapered portion 38A is inclined more gently than the second tapered portion 38B and serves as a guide for facilitating accommodation when the barrel 18 is accommodated through the front opening 22 of the accommodating portion 20. Further, the first and second plates 36A, 36B have no undercut when a mold is pulled out upward from the accommodating portion 20 at the time of resin-molding the terminal cover 10. Thus, the terminal cover 10 can be molded without any slide structure, and cost for the mold can be suppressed. Further, the terminal cover 10 need not be provided with a hole for removing the mold for forming the first and second plates 36A, 36B.

When the barrel 18 is accommodated into the accommodating portion 20, as shown in FIG. 4, end parts (i.e. first and second tapers 38A, 38B) of the pressing portions 34 in the projecting directions resiliently contact the side parts 18A, 18B of the barrel 18. The first and second tapers 18A, 18B are inclined toward the front opening 22 so that the barrel 18 is pushed toward the front opening 22 while sliding on the tapers 38 by reaction forces generated by the resilient contact of the pressing portions 34 with the barrel 18. Further, by closing the lid 16, the barrel 18 is sandwiched between the lid 16 and the two pressing portions 34 to suppress a displacement of the barrel 18 in the front-rear direction in the accommodating portion 20.

Further, the first plates 36A are inclined obliquely up and the second plates 36B are inclined obliquely down, as shown in FIG. 1. Thus, the second plates 36B inclined in the oblique downward directions suppress an upward displacement of the barrel 18 if the barrel 18 is going to be displaced upward, and the first plates 36A inclined in the oblique upward directions suppress a downward displacement of the barrel 18. In this way, displacements of the barrel 18 in the vertical direction (i.e. extending direction D1) are suppressed in the accommodating portion 20.

As described above, since the two pressing portions 34 resiliently contact both sides 18A, 18B of the barrel 18, displacements of the barrel 18 in the direction intersecting the mounting direction of the lid 16 (i.e. in the direction intersecting both the axial direction D2 of the front opening 22 and the extending direction D1 of the wire W) can be suppressed. Further, since the tapered ends 38 of the pressing portions 34 are tapered to incline toward the front opening 22, when the tapered ends 38 of the pressing portions 34 resiliently contact the barrel 18, the barrel 18 is pushed toward the front opening 22 while sliding on the tapered ends 38, thereby being sandwiched between the lid 16 and the pressing portions 34 to restrict a displacement of the barrel 18 toward the front opening 22.

Further, since the first tapered portions 38A located on the side near the front opening 22 are inclined more gently than the second tapered portions 38B located on the side distant from the front opening 22, the first tapered portions 38A serve as the guides in accommodating the barrel 18 through the front opening 22 of the accommodating portion 20 and the barrel portion 18 is accommodated easily.

Further, the first plates 36A project obliquely toward the first side in the extending direction D1 and the second plate portions 36B projects obliquely toward the second side in the extending direction D1. Thus, a displacement of the barrel 18 in the extending direction D1 can be suppressed. For example, if the barrel 18 is going to be displaced toward the first side in the extending direction D1 of the wire W, a displacement of the barrel 18 toward the first side is suppressed by the second plates 36B projecting toward the second side in the extending direction D1. Further, if the barrel 18 is going to be displaced toward the second side in the extending direction D1 of the wire W, a displacement of the barrel 18 toward the second side is suppressed by the first plates 36A projecting toward the first side in the extending direction D1.

The invention is not limited to the above described and illustrated embodiment. For example, the following various modes are also included.

Figure 6:
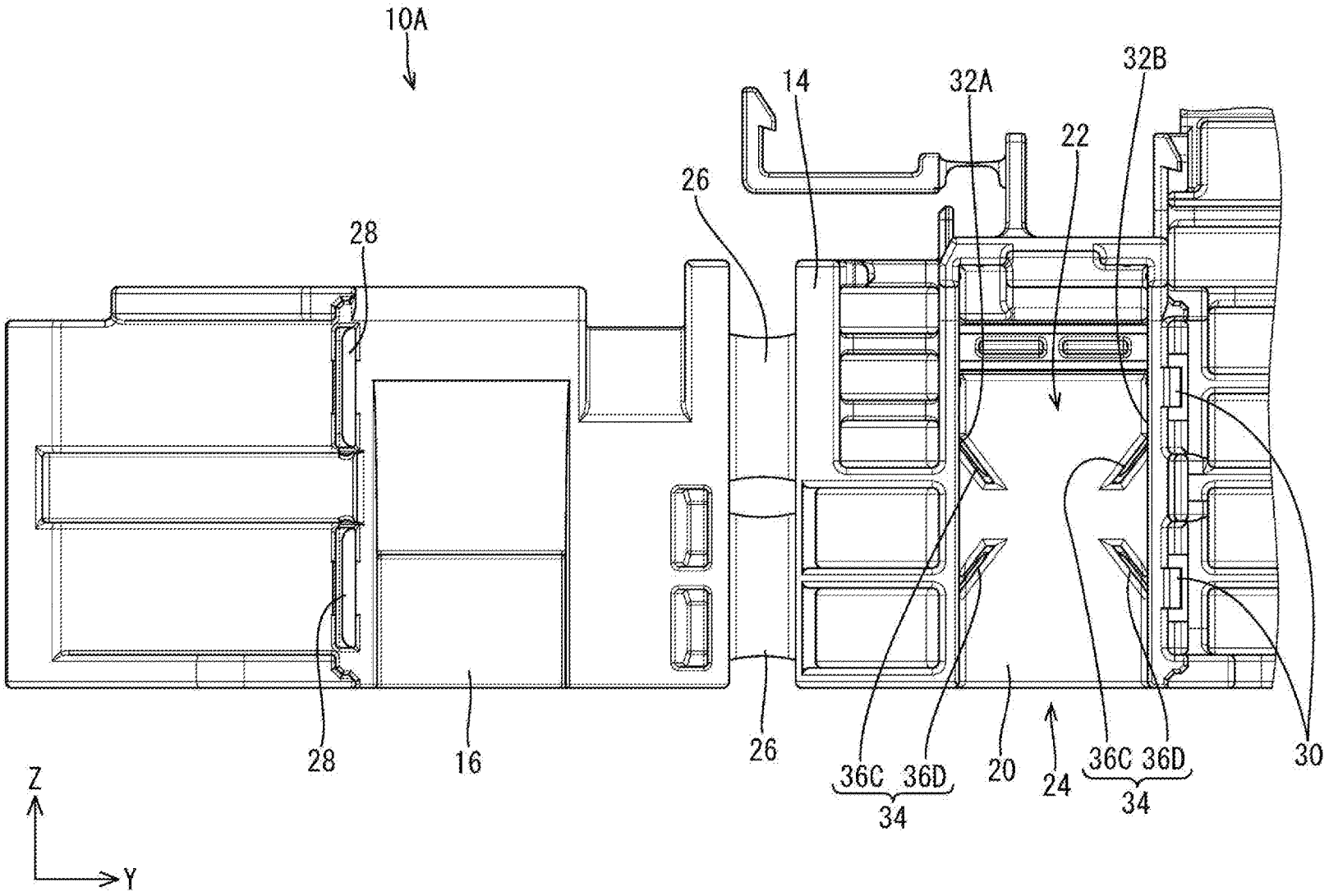
FIG. 6 is a front view of a terminal cover in another embodiment (1).

In the above embodiment, the pressing portion 34 of the terminal cover 10 is composed of the first plate 36A projecting obliquely up from the central part of the inner wall 32A, 32B and the second plate 36B projecting obliquely down from the central part of the inner wall 32A, 32B. However, as shown in FIG. 6, a first plate 36C of a terminal cover 10A may project in an oblique down from an upper part of an inner wall 32A, 32B and a second plate 36D may project obliquely up from a lower part of the inner wall 32A, 32B.

Although the pressing portion 34 is composed of the first plate 36A projecting obliquely up from the central part of the inner wall 32A, 32B and the second plate 36B projecting obliquely down from the central part of the inner wall 32A, 32B in the above embodiment, a pressing portion may be provided with only one of first and second plates. Further, the first and second plates both may be inclined obliquely up or both may be inclined in obliquely down.

The invention can be applied also to barrels shaped and sized differently from the barrel 18 of the above embodiment similarly to the above embodiment by adjusting lengths of the first and second plates in the projecting directions and angles between the inner walls and the pressing portions.

LIST OF REFERENCE SIGNS

10, 10A: terminal cover
12: terminal fitting

14: body
16: lid
18: barrel
18A, 18B: side part
20: accommodating portion
22: front opening (opening)
32A: left inner wall (one inner wall)
32B: right inner wall (other inner wall)
34: pressing portion
36A, 36C: first plate
36B, 36D: second plate
38: tapered end
38A: first tapered portion
38B: second tapered portion
D1: extending direction
D2: axial direction

What is claimed is:

1. A terminal cover (10) for protecting a terminal fitting (12) to be crimped to an end part of a wire (W) and including a barrel (18), comprising:

an accommodating portion (20) including an opening (22), the barrel (18) being accommodated into the accommodating portion (20) through the opening (22);

a lid (16) configured to cover the opening (22) of the accommodating portion (20); and two plate-like pressing portions (34) projecting obliquely toward the barrel (18) from first and second opposed inner walls (32A, 32B) of the accommodating portion (20) that face each other in a direction intersecting both an axial direction of the opening (22) and an extending direction of the wire (W), the pressing portions (34) respectively resiliently contacting both sides of the barrel (18);

end parts of each of the pressing portions (34) in a projecting direction being formed into a taper (38) inclined toward the opening, the tapers (38) of the pressing portions (34) resiliently contacting both sides of the barrel (18), the barrel (18) being pushed toward the opening and sandwiched between the lid 16) and the pressing portions (34) by reaction forces of the pressing portions (34).

2. The terminal cover (10) of claim 1, wherein the taper (38) includes a first tapered portion (38A) located on a side near the opening (22) and a second tapered portion (38B) located on a side distant from the opening (22), and the first tapered portion (38A) is inclined more gently than the second tapered portion (38B).

3. The terminal cover of claim 2, each of the pressing portions (34) includes:

a first plate (36A, 36C) projecting in an oblique direction toward a first side in the extending direction, the first plate (36A, 36C) resiliently contacting the side of the barrel (18); and a second plate (36B, 36D) projecting in an oblique direction toward a second side in the extending direction, the second plate (36B, 36D) resiliently contacting the side of the barrel (18).

4. The terminal cover of claim 1, each of the pressing portions (34) includes:

a first plate (36A, 36C) projecting in an oblique direction toward a first side in the extending direction, the first plate (36A, 36C) resiliently contacting the side of the barrel (18); and a second plate (36B, 36D) projecting in an oblique direction toward a second side in the extending direction, the second plate (36B, 36D) resiliently contacting the side of the barrel (18).

* * * * *